US010065305B2

(12) United States Patent
Lostlen

(10) Patent No.: US 10,065,305 B2
(45) Date of Patent: Sep. 4, 2018

(54) TRANSFER TOOL FOR CABINET HOLES

(71) Applicant: Tad K. Lostlen, Morongo Valley, CA (US)

(72) Inventor: Tad K. Lostlen, Morongo Valley, CA (US)

( * ) Notice: Subject to any disclaimer, the term of this patent is extended or adjusted under 35 U.S.C. 154(b) by 252 days.

(21) Appl. No.: 15/259,552

(22) Filed: Sep. 8, 2016

(65) Prior Publication Data

US 2017/0066125 A1 Mar. 9, 2017

Related U.S. Application Data

(60) Provisional application No. 62/215,863, filed on Sep. 9, 2015.

(51) Int. Cl.
*B25H 7/02* (2006.01)
*A47B 97/00* (2006.01)

(52) U.S. Cl.
CPC ..... *B25H 7/02* (2013.01); *A47B 97/00* (2013.01)

(58) Field of Classification Search
CPC ..... B23B 47/287; B23B 2247/08; B23B 2260/088; A47B 97/00; B25H 7/02
USPC ..... 33/452, 456, 528
See application file for complete search history.

(56) References Cited

U.S. PATENT DOCUMENTS 70,547 A * 11/1867 Graham ..... G01B 3/56 33/419
D136,978 S * 1/1944 Tomasini ..... 33/561.1
2,770,043 A * 11/1956 Kwiecinski ..... E04F 21/1838 33/452
2,990,733 A * 7/1961 Garcia ..... B23B 47/287 101/112
3,522,658 A 8/1970 Howell
3,672,064 A 6/1972 Elkins et al.
D230,628 S 3/1974 Sunley
3,808,690 A 5/1974 Balder
3,842,510 A 10/1974 Elliott
4,059,907 A 11/1977 Dauber
4,827,625 A * 5/1989 Le Moal ..... A47G 27/0487 33/527
5,617,642 A * 4/1997 Marios ..... B25H 7/02 33/452
5,813,803 A * 9/1998 Sommerfeld ..... B23B 47/28 408/103
6,725,551 B1 4/2004 Sutton
7,302,763 B1 * 12/2007 Matthews ..... E04G 21/1891 33/451

(Continued)

*Primary Examiner* — Yaritza Guadalupe-McCall
(74) *Attorney, Agent, or Firm* — Kirk A. Buhler; Buhler & Associates

(57) ABSTRACT

Improvements in a transfer tool for cabinet holes to transfer a plurality of different size and shape holes from one surface to another. The openings for a sink cabinet typically has a hot and a cold water supply line in addition to a drain pipe with an outlet for a garbage disposal and the location of all the holes and sizes must be identified, and transferred to a cabinet. The transfer tool accommodates a starting corner from a variety of different sizes and shapes cabinets and surfaces. The transfer tool has locators for both the size and the center position of round, square and other style openings. The transfer tool has indicia that identifies the size and center position to allow an installer to simply re-mark the location. The transfer tool has versatility to operate around obstructions and other hole opening locations.

20 Claims, 6 Drawing Sheets

(56) References Cited

U.S. PATENT DOCUMENTS

| | | | | |
|---|---|---|---|---|
| 8,943,704 | B1 | 2/2015 | Scammel | |
| 2017/0066125 | A1* | 3/2017 | Lostlen | B25H 7/02 |

* cited by examiner

FIG. 4
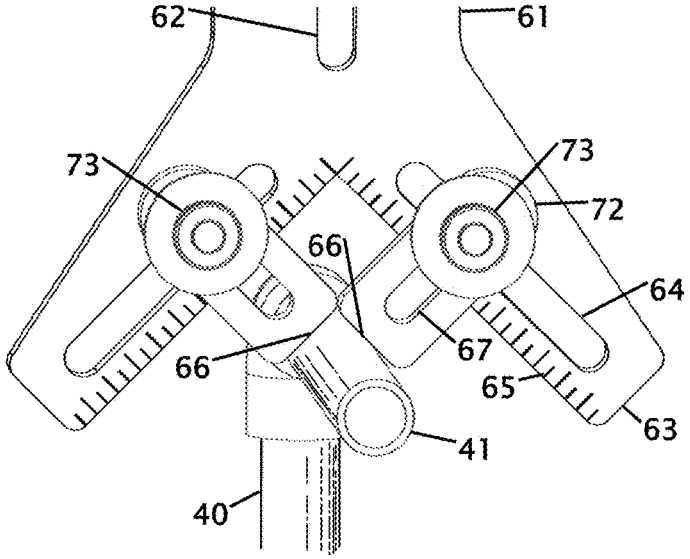
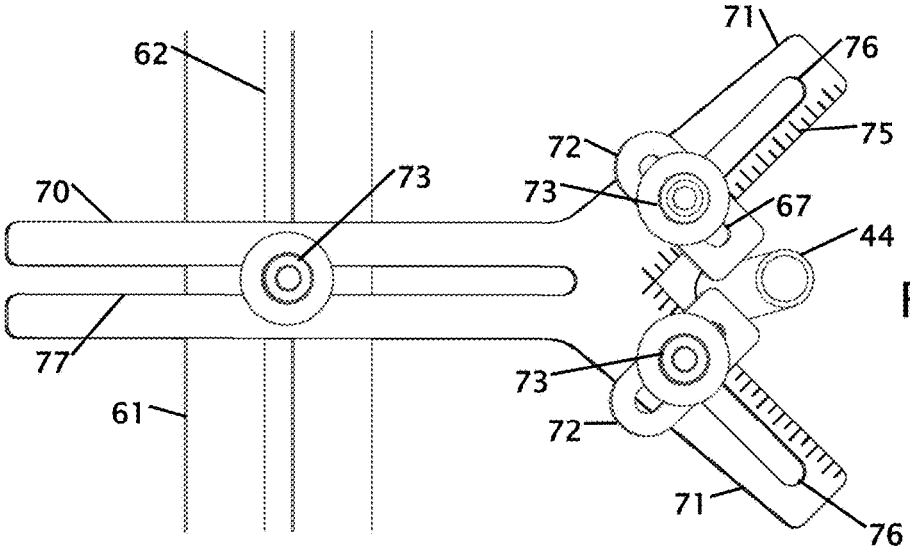
FIG. 5

TRANSFER TOOL FOR CABINET HOLES

CROSS REFERENCE TO RELATED APPLICATIONS

This application claims the benefit of Provisional Application Ser. No. 62/215,863 filed Sep. 9, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the invention

This invention relates to improvements in an adjustable transfer locating and marking system for holes. More particularly, the present transfer tool for cabinet holes allows an installer to locate multiple holes on a wall for plumbing and or outlets and then transfer the size and locations to a cabinet. The holes can then be accurately cut into the cabinet.

Description of Related Art including information disclosed under 37 CFR 1.97 and 1.98.

When installing a cabinet, sheetrock, drywall or paneling in a house, office or kitchen the locations and size of the water supply, drain, electrical outlets or other items that extend through the wall requires an opening. Typically an installer will take measurements from a corner to approximate the center and then repeat the measurements on the back of the cabinet. This is repeated for each measurement until all of the locations are identified and then the holes are cut or drilled. The accuracy of these multiple approximate locations can result in cutting large holes or openings that are not centered.

There have been some tools that identify one or more openings. Some patents and or publications have been made to address these issues. Exemplary examples of patents and or publication that try to address this/these problem(s) are identified and discussed below.

U.S. Pat. No. 3,522,658 issued on Aug. 4, 1970 to John F. Howell discloses an Electrical Outlet Box Locator. The electrical outlet box locator mounts in a room between the ceiling and the floor. The device has an arm that locates an electrical box on a stud wall. The arm is rotated away and the sheetrock is moved into position. The arm is then rotated to the sheetrock and the marking is then transferred to the sheetrock where the location of the hole is identified. While this patent allows for marking of the ceiling and the floor in the location where a cabinet would be located. It further does not accommodate the multiple holes for a cabinet.

U.S. Pat. No. 4,059,907 issued on Nov. 29, 1977 to Howard Dauber discloses an Electrical Outlet and Switchbox Locator. This patent uses a framework of spaced vertical telescoping members and spaced horizontal telescoping members is adjustable positioned in front of a wall having an electrical outlet. While this patent allows for a transfer for marking openings for electrical outlets, it straddles the width of sheetrock and only allows or one openings in a horizontal direction.

U.S. Pat. No. 8,943,704 issued on Feb. 3, 2015 to William Lee Scammel discloses an Apparatus for Locating Fixture Boxes and the Like. This patent also requires installation between the floor and ceiling. Because the device will occupy the same location where a cabinet will be installed and does not mark a back of a cabinet it is not operable for the intended purpose.

What is needed is a marking transfer device that locates all of the openings and holes from one surface and can transfer the plurality of holes and locations to the back surface of a cabinet. The proposed transfer tool for cabinet holes provides the solution for not only cabinets, but can also be used with sheetrock, drywall and other marking needs where the markings can be made to either side or mirror side.

BRIEF SUMMARY OF THE INVENTION

It is an object of the transfer tool for cabinet holes to transfer a plurality of different size and shape holes from one surface to another. The openings for a sink cabinet typically has a hot and a cold water supply line in addition to a drain pipe with an outlet for a garbage disposal. The back of the cabinet therefore typically requires at least four holes. For a quick installation, an installer can simply cut the majority of the back surface of a cabinet. While this will add access to the plumbing, it provides a large opening where material can fall between the cabinet and the wall.

It is an object of the transfer tool for cabinet holes to accommodate a starting corner from a variety of different surfaces. Wall cabinets come in a variety of different sizes and shapes. The transfer tool must accept the different configurations to locate all of the openings. Generally, the ground and one side is selected as a datum location. The side is either a wall, a level line on the wall or another cabinet that has been set. All locations can then be made from this datum location. Once the wall openings have been identified the transfer tool is removed from the wall and then placed against the back of the cabinet where they can be accurately located in both size and location.

It is another object of the transfer tool for cabinet holes to have locators for both the size and the center position. In the case of a drain pipe, determining the diameter and the center can be difficult as an installer measures using a tape measure. The transfer tool can have indicia that identifies the size and center position to allow an installer to simply re-mark the location using just a pencil, screw or nail without requiring any additional measurements.

It is still another object of the transfer tool for cabinet holes to be able to operate around obstructions with multiple locating members. In the case of a kitchen the water supply and drain can be in-line with each other. The location of a drain pipe between a hot and a cold water pipe can be difficult with other marking systems. Because the disclosed system allows for great versatility to operate around obstructions and other hole opening locations.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

FIG. 4 shows the transfer tool marking a pipe from a top location.

FIG. 5 shows the transfer tool marking a pipe from a side location.

DETAILED DESCRIPTION OF THE INVENTION

Figure 1:
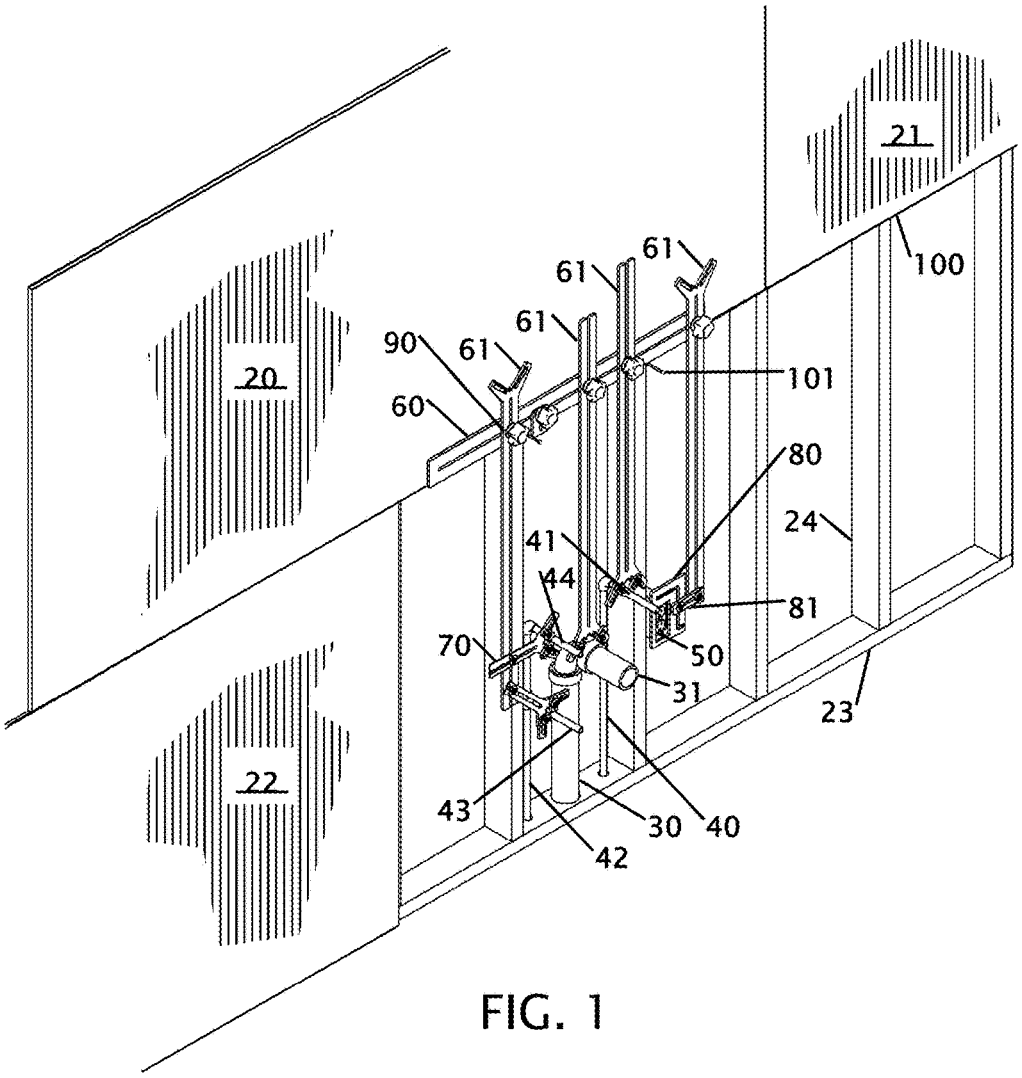
FIG. 1 shows a transfer tool on a wall.

FIG. 1 shows a transfer tool on a wall. This wall shows three sheets 20, 21 and 22 mounted on vertical studs 24 on a footer 23. The transfer tool has a main supporting member 60. The main supporting member 60 aligns with a horizontal edge of a cabinet, panel or side of a sheet of sheetrock 20 or any level line drawn as a reference. The main supporting member 60 is located on the sheetrock with fasteners 101. In this view the fastener is a nail or screw 101 that is placed on the bottom surface 100 of the sheetrock 20. A number of locating arms 61 are secured to the main supporting member 61. The locating arms 61 can be positioned with either side up or down. While the orientation of the locating arm(s) 61 to the main support member 60 is predominantly shown in orthogonal vertical or horizontal relationship these components can be connected in an angular relationship to move the components around obstructions to locate all of the openings in a single set-up.

Each end of the locating arm 61 has a different. One end has a straight end, while the other ends has a "Y" configuration. The locating arms 61 have an elongated slot that is secured in the elongated slot in the main supporting member 60. A threaded clamp comprising of a nut, bolt or similar fastener that passes through the slots in the locating arm 61 and the main supporting member 60 is secured with a knob 90 having a tapped central hole that the threaded clamp tightens onto to secure the locating arm 61 onto the support member 60.

From the left, the first locating arm 61 is secured to the supporting member 60 with the "Y" in the upper orientation. Two "Y" locators 70 are secured to the lower portion of the locating arm 61 with securing fasteners 73 that are threaded to allow for quick repositioning and securing on the locating arm 61. The "Y" locators 70 locate two separate supply pipes 43 and 44. These separate pipes can be used to supply water to both a sink and to a dishwasher. Both pipes 43 and 44 receive water from a single pipe 42. Because this pipe is located on the left side of drain pipe 31 it is typically a hot water supply.

The second locating arm 61 is secured to the main supporting member 60 with the "Y" in an inverted orientation. The location of the drain is further identified with optional tabs that are more clearly shown and described in other figures within this document. The optional tabs may be used with spacers, such as clearance, kerf or others to adjust for a proper hole saw. The drain pipe 31 extends down into the footer 23, and then through 60 the floor or foundation into the sewer.

The third locating arm 61 is also secured in with the "Y" in an inverted orientation and locates the position of a cold water supply pipe 41 that rises 40 from the floor or foundation.

The final locating arm 61 is shown with the "Y" in the upper orientation. The bottom of this locating arm retains an extension 81 that connects to an outlet 50 locator 80 having a "Z" opening that allows the outlet locator 80 to be placed in different orientations by moving the mounting around the "Z" opening.

Figure 2:
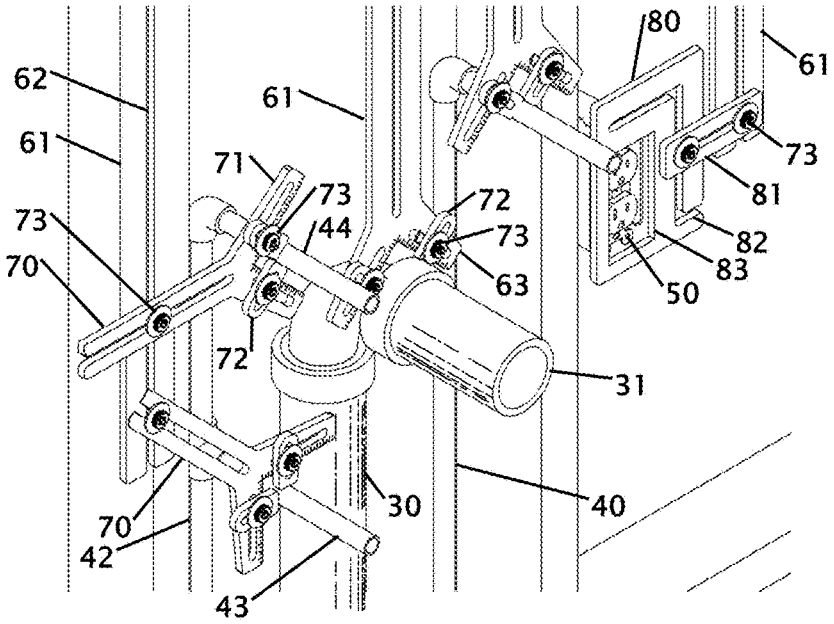
FIG. 2 shows a first detail view of the transfer tool on a wall.
Figure 3:
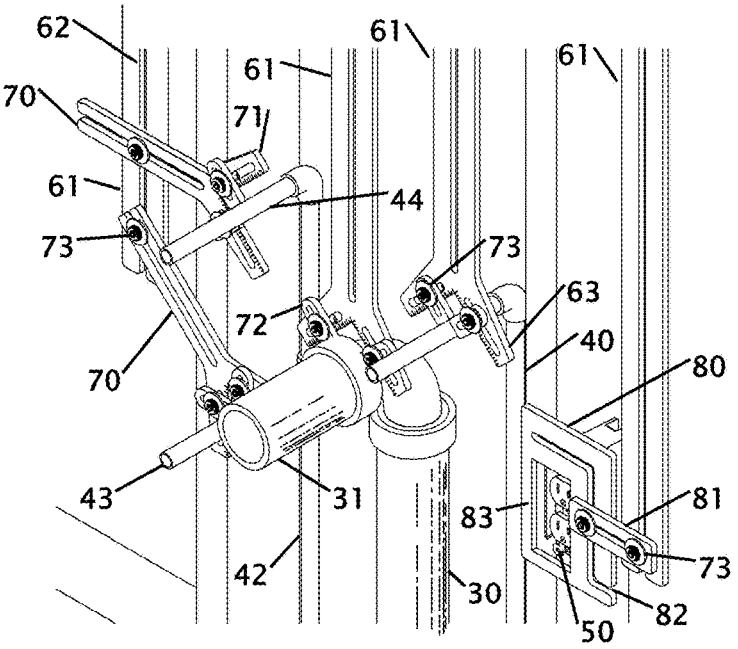
FIG. 3 shows a second detail view of the transfer tool on a wall.

FIG. 2 shows a first detail view of the transfer tool on a wall and FIG. 3 shows a second detail view of the transfer tool on a wall. These two views provide different perspectives to view the different elements of the transfer tool. The supporting member is cropped from above these views. Each locating arm 61 has a slot 62 that is centered along the length of the locating arm, including the "Y" extensions from the locating arm 61. This slot 62, allows multiple locations for securing multiple "Y" locator 70 components for locating one or more pipes.

The "Y" locators 70 are shows with a plurality of tabs 72 that are secured in slots to mark the location of pipes 43 and 44. The two marks are used to align the circumference of a hole saw or other hole making tool. While this use is disclosed, the "Y" locators 70 can be used in other ways, like drawing the hole with a template or compass, to eliminate trying to find the center of the pipe at the edge on the radius because it is tedious. It is generally easier to find hole centers by first finding the edge, then doing the math. In this case the math is: Pipe diameter plus desired clearances (purpose spacer tab 72) equals hole saw size.

The tabs 72 also have slots to tangently contact the pipes 43 and 44. The tabs have center marking indicia whereby the location of the center of the hole can be located and marked. A similar set of tabs 72 are used on the "Y" side of the locating arms 61. These tabs 72 are also secured with fasteners 73 securing the ends 63 of the "Y" arms. The fasteners 73 are loosened and the tabs 72 are moved along the slots to locate the center tangent position of the supply 41, 43, 44 or drain pipe(s) 31.

An outlet 50 provides power to supply an electric water heater, garbage disposal or dishwasher. This figure shows a dual outlet 50 placed in a vertical arrangement, but the outlet could have four or more sockets. The bottom of this locating arm 61 retains an extension 81 that connects to an outlet 50 locator 80 having a "Z" opening that allows the outlet locator 80 to be placed in different orientations.

FIG. 4 shows the transfer tool marking a pipe 41 from a top location. Slots 64 retain tabs 72 through slots 64 with retainers or clamps 73. Each arm of the "Y" have marking indicia 65 that provides measurements for the location of the pipe 41 relative to the split in the "Y".

FIG. 5 shows the transfer tool marking a pipe from a side location. The "Y" locator 70 is secured to the lower portion of the locating arm 61 with securing fasteners 73 that are threaded to allow for quick repositioning and securing on the locating arm 61. Slots 75 retain tabs 72 through slots 76 with retainers or clamps 73. Each arm of the "Y" locator 70 have marking indicia 75 that provides measurements for the location of the pipe 45 relative to the split in the "Y". Slot 77 allows the position of the "Y" locator 70 to be optimized for identifying the location of the pipe 44.

Figure 6:
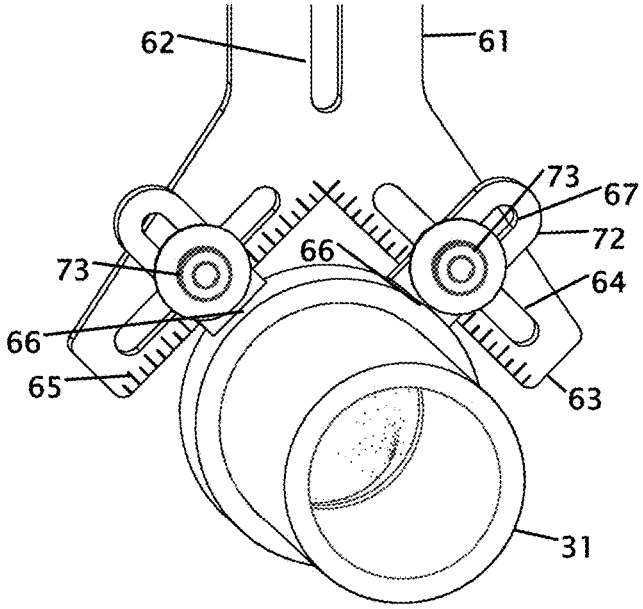
FIG. 6 shows the transfer tool marking a drain pipe from a top location.

FIG. 6 shows the transfer tool marking a drain pipe from a top location. Slots 64 retain tabs 72 through slots 64 with retainers or clamps 73. Each arm of the "Y" have marking indicia 65 that provides measurements for the location of the drain pipe 31 relative to the split in the "Y". The measurement indicia 65 identifies not only the center of the hole, but can also be used to identify the diameter of the pipe or drain. The marking indicia can be in inches, millimeters, radius or diameter.

Figure 7:
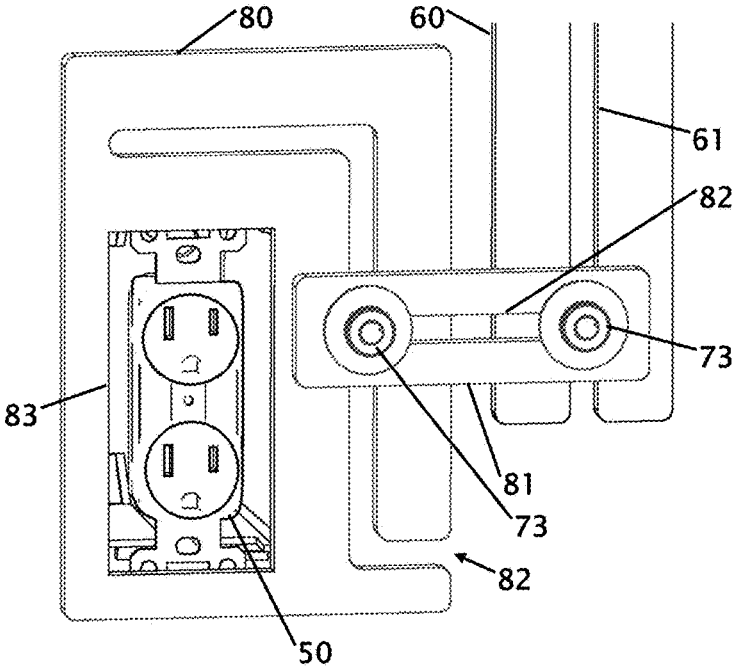
FIG. 7 shows the transfer tool marking an electrical outlet.

FIG. 7 shows the transfer tool marking an electrical outlet 50. This figure shows a dual outlet 50 placed in a vertical arrangement, but the outlet could have four or more sockets. The bottom of this locating arm 61 retains an extension 81 that connects to an outlet 50 locator 80 having a "Z" opening 82 that allows the outlet locator 80 to be placed in different orientations. Fasteners/retainers 73 on each end of the extension 81 locate and help orient the outlet opening.

Figure 8:
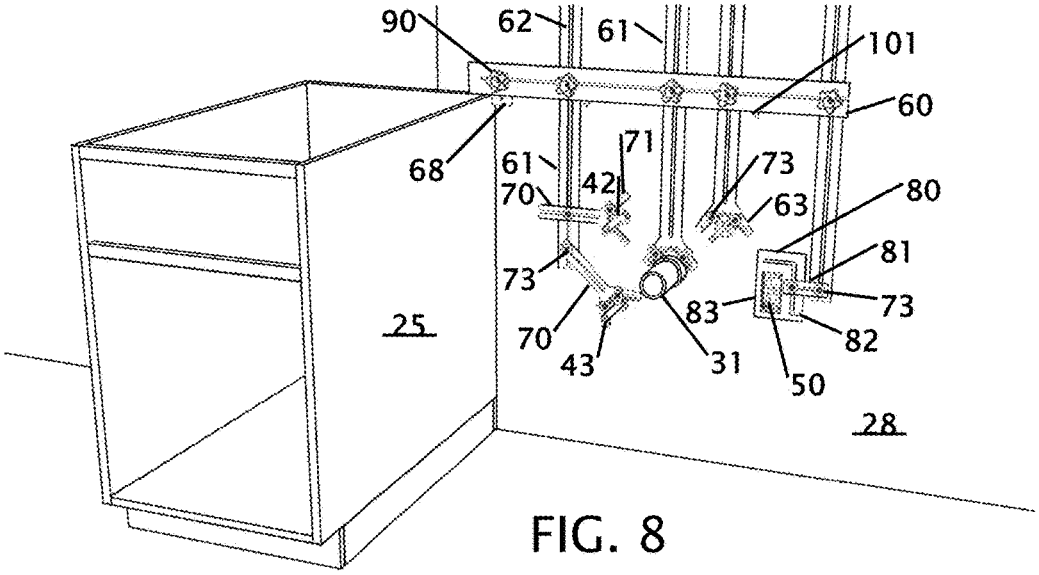
FIG. 8 shows the transfer tool locating the holes on a wall.

FIG. 8 shows the transfer tool locating the holes on a wall 28. The transfer tool is located on a wall with the main supporting member 60 located on a wall 28 with fasteners 101. In this view, the fastener is a nail or screw 101 that is level with the top surface of an adjoining cabinet or side of a wall or corner. A locating tab or finger 68 locates the side of the adjoining cabinet 25. The locations of all the required holes and openings are located as previously described. Once the locations have all been identified the transfer tool is lifted from the fasteners 101 and then placed onto the back of the cabinet as shown and described in the next figure.

Figure 9:
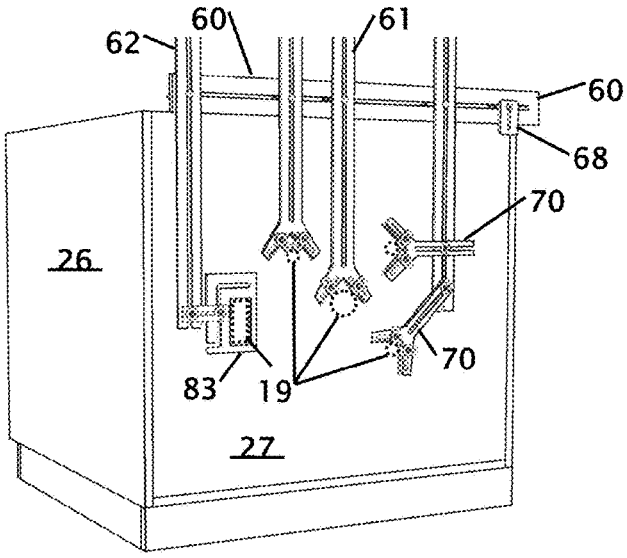
FIG. 9 shows the transfer tool locating the identified holes on the back of a cabinet.

FIG. 9 shows the transfer tool locating the identified holes on the back 27 of a cabinet 26. Broken lines 19 show where the opening or holes will be cut into the back of the cabinet. The locating tab or finger 68 is aligned with the mating edge or side of the cabinet and the main supporting member 60 is located on the top of the cabinet 26. All of the hole locations can then be accurately marked and the holes can be placed in the back of the cabinet 26. The cabinet 26 can then be simple moved into position against the wall 28 and all of the openings can pass through the back 27 of the cabinet 26 with precision. This minimizes gaps around the plumbing and electrical openings. All of the holes can be located and cut in a single operation.

Figure 10:
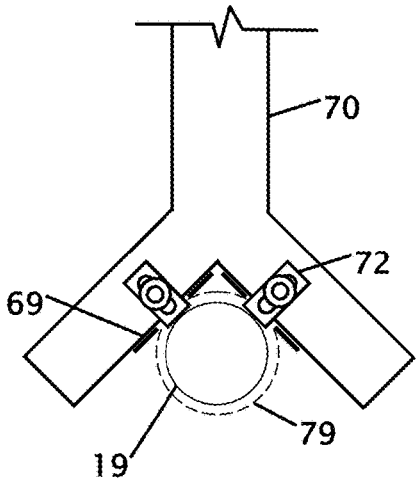
FIG. 10 shows the marking and cutting of a hole.
Figure 11A:
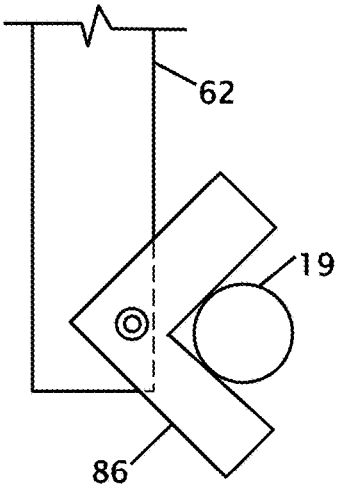
FIG. 11A shows marking a circle with an angle bracket.
Figure 11B:
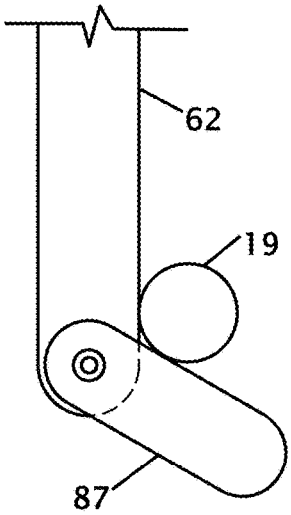
FIG. 11B shows marking a circle with a single leg.
Figure 11C:
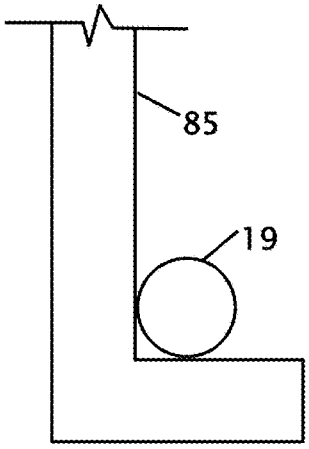
FIG. 11C shows marking a circle with an "L" bracket.

FIG. 10 shows the marking and cutting of a hole with the retaining tabs 72 on the locator 70. The "Y" locators 70 can be used in other ways, like marking the edges 69 or drawing the hole 79 with a template or compass, to eliminate trying to find the center of the pipe at the edge on the radius because it is tedious. In this figure the pipe 19 is shown inside of the larger hole 79 that is drawn and cut with some clearance. The tabs 72 are arranged slightly to make the marking 69 of the cut hole easier. The tabs 72 are set with index marks or a tape measure. FIGS. 11A, 11B and 11C are examples of how a plumbing locations could be transferred. FIG. 11A shows marking a circle 19 with an angle bracket 86, FIG. 11B shows marking a circle 19 with a single leg 87 and FIG. 11C shows marking a circle 19 with an "L" bracket 85.

Thus, specific embodiments of a transfer tool for cabinet holes have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A transfer tool for identifying hole locations comprising:

a flat main supporting member;

said flat main supporting member having at least one elongated slot;

at least one flat locating arm that is temporally securable onto said flat main supporting member through a slot in said least one flat locating arm with a fastener;

said least one flat locating arm having a first end that is elongated and having said at least one elongated slot running essentially central along said least one flat locating arm said least one locating arm further having a second end forming a split "Y";

each end of said split "Y" features having a slot that runs essentially central to said split features;

at least two locating tabs temporally securable to each of said split "Y" sides, whereby said at least two locating tabs identify a physical feature relative to said flat main supporting member.

2. The transfer tool according to claim 1 further including at least one "Y" locator.

3. The transfer tool according to claim 2 wherein said at least one "Y" locator is temporally securable to said at least one elongated slot.

4. The transfer tool according to claim 3 herein said at least one "Y" locators have two perpendicular slots.

5. The transfer tool according to claim 4 wherein each of said two perpendicular slots have marking indicia.

6. The transfer tool according to claim 5 wherein said indicia indicated a diameter of a plumbing pipe.

7. The transfer tool according to claim 6 wherein said indicia indicate a center of said plumbing pipe.

8. The transfer tool according to claim 4 wherein each of said two perpendicular slots each have locator tabs.

9. The transfer tool according to claim 8 wherein each of said locator tabs are temporally positionable in said two perpendicular slots with fasteners.

10. The transfer tool according to claim 8 wherein each of said locator tabs have elongated slots.

11. The transfer tool according to claim 1 further includes an electrical outlet template.

12. The transfer tool according to claim 11 wherein said electrical outlet template has a slot extending along at least one side of said electrical outlet template.

13. The transfer tool according to claim 11 wherein said electrical outlet template has an "L" shaped slot that extends around two sides of said electrical outlet template.

14. The transfer tool according to claim 11 wherein said electrical outlet template connects to said flat main support or said "y" locator with a locator tab.

15. The transfer tool according to claim 1 further includes a wall with at least one plumbing connection.

16. The transfer tool according to claim 15 further includes at least one cabinet.

17. The transfer tool according to claim 16 wherein said transfer tool is configured to be articulated to locate a position of said plumbing connection.

18. The transfer tool according to claim 17 wherein said transfer tool is configured to be located onto said at least one cabinet.

19. The transfer tool according to claim 15 further includes at least one locator tab that identifies a datum location on said wall.

20. The transfer tool according to claim 19 wherein said datum location is common to said wall and to at least one cabinet.

* * * * *